US005485143A

United States Patent [19]

Keniston

[11] Patent Number: 5,485,143

[45] Date of Patent: Jan. 16, 1996

[54] SECURITY DYE PACK HAVING FLEXIBLE HEAT-RESISTANT CHEMICAL POUCH

[75] Inventor: Scott E. Keniston, Scottsdale, Ariz.

[73] Assignee: U.S. Currency Protection Corp., Fountain Hills, Ariz.

[21] Appl. No.: 391,838

[22] Filed: Feb. 21, 1995

Related U.S. Application Data

[63] Continuation of Ser. No. 86,682, Jul. 2, 1993, abandoned.

[51] Int. Cl.[6] ..... G08B 13/14

[52] U.S. Cl. ..... 340/568; 340/571; 340/693; 42/1.08; 42/1.13; 109/25; 109/29; 109/31; 109/38

[58] Field of Search ..... 340/568, 571, 340/572, 539, 691; 116/2, 104, 211, 214, 217, 218, 219; 42/1.08, 1.13

[56] References Cited

U.S. PATENT DOCUMENTS

| | | | |
|---|---|---|---|
| Re. 27,618 | 4/1973 | Robeson | 340/224 |
| 3,303,592 | 2/1967 | Harner | 42/1.08 |
| 3,424,122 | 1/1969 | De Angelis | 116/2 |
| 3,564,525 | 2/1971 | Robeson | 340/224 |
| 3,781,860 | 12/1973 | Freyling, Jr. | 340/280 |
| 3,828,341 | 8/1974 | Carter, Jr. et al. | 340/280 |
| 4,511,888 | 4/1985 | Bernhardt | 340/571 |
| 4,559,529 | 12/1985 | Bernhardt | 340/571 |
| 4,604,607 | 8/1986 | Sanderford, Jr. et al. | 340/539 |
| 5,059,949 | 10/1991 | Caparoni et al. | 340/571 |
| 5,196,828 | 3/1993 | Keniston | 340/571 |

FOREIGN PATENT DOCUMENTS

| | | |
|---|---|---|
| 0033661 | 12/1981 | European Pat. Off. . |
| 0355404 | 2/1990 | European Pat. Off. . |

OTHER PUBLICATIONS

ICI "FlexPac" brochure entitled Real Cash.

*Primary Examiner*—Brent A. Swarthout
*Assistant Examiner*—Benjamin C. Lee
*Attorney, Agent, or Firm*—Cahill, Sutton & Thomas

[57] ABSTRACT

A security dye pack disguised as a bundle of currency for deterring robberies includes a housing formed from a stack of currency bills sewn together and having a hollow chamber formed therein. A printed circuit board is disposed within the chamber for supporting electrical components which generate an actuating signal upon detecting removal of the security dye pack from the protected premises. A flexible pouch containing dye, tear gas, or other active chemicals, is secured at one end of the printed circuit board, and a squib extends into the pouch to ignite the chemical mixture when the actuating signal is generated. The flexible pouch is formed of a heat-resistant plastic film which is easily bendable. Foam cushions, protected by heat-resistant film, are disposed above and below the pouch and circuit board. Heat resistant plastic sheets extend about the foam cushions and are secured by an elastic thread to the housing to retain the components within the hollow chamber.

15 Claims, 3 Drawing Sheets

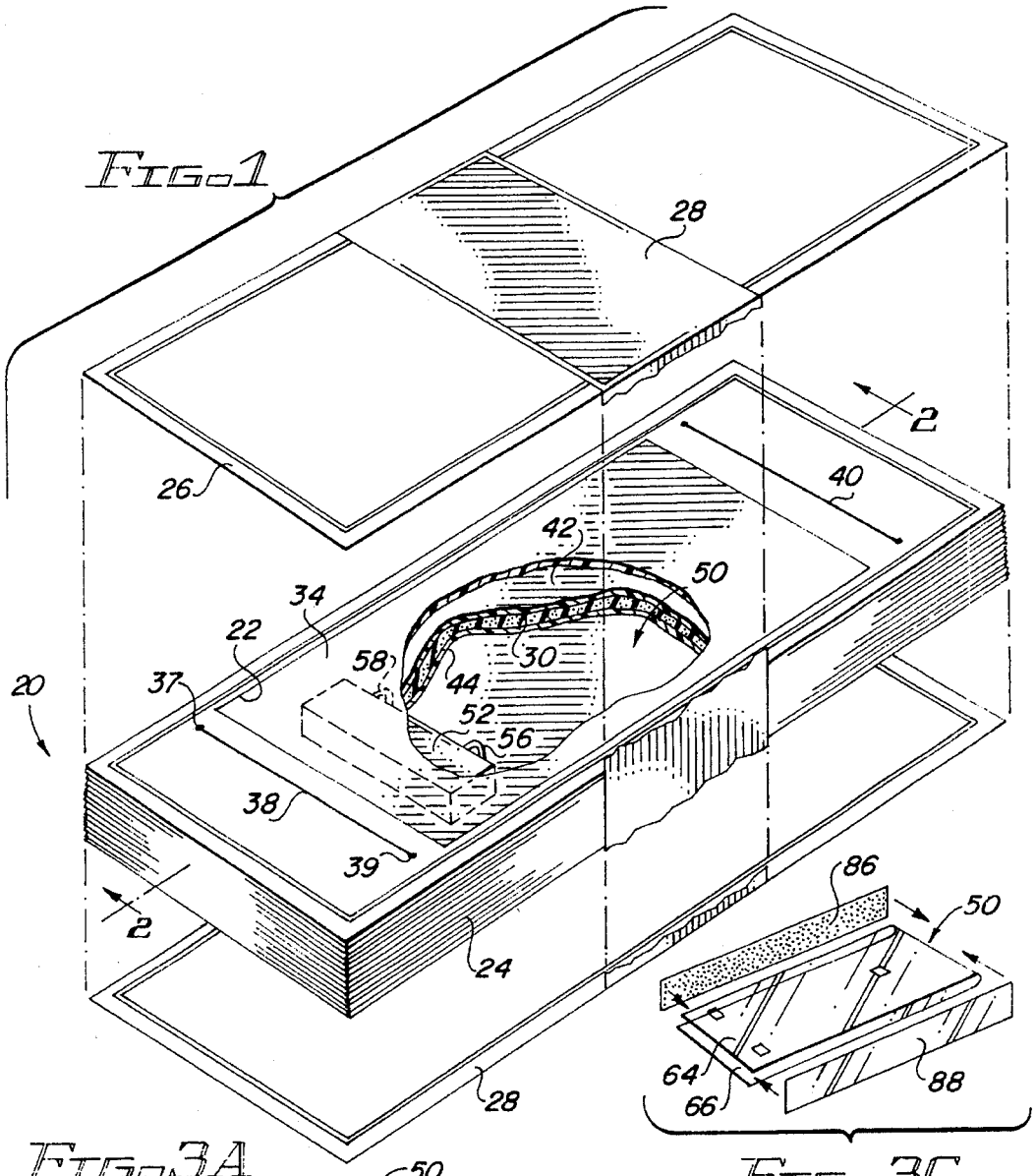
FIG. 3C
FIG. 3A
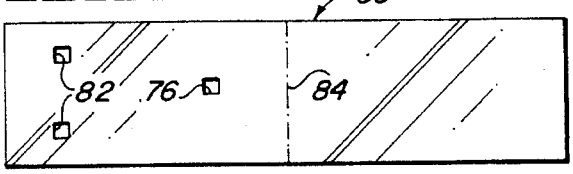
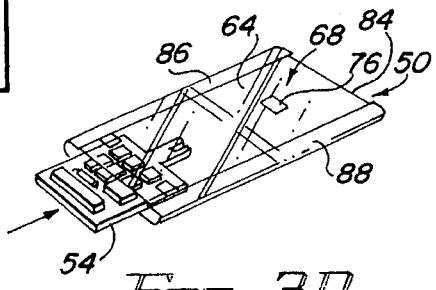
FIG. 3D
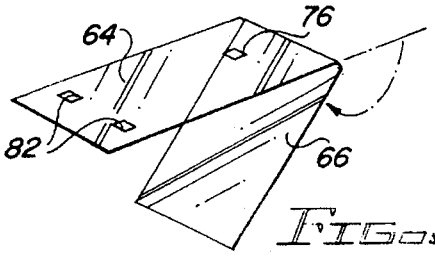
FIG. 3B

SECURITY DYE PACK HAVING FLEXIBLE HEAT-RESISTANT CHEMICAL POUCH

This is a continuation of application Ser. No. 08/086,682 filed Jul. 2, 1993, now abandoned.

BACKGROUND OF THE INVENTION

1. Field of the Invention

The present invention relates generally to security systems for aiding authorities in the apprehension of bank robbers and the recovery of stolen monies, and more particularly, to security systems employing currency packs disguised as bundles of currency bills for discharging tear gas, dye, smoke and/or other chemicals in the event of a robbery.

2. Description of the Relevant Art

Among the devices which have been used by banks and other financial institutions to deter bank robberies, and to aid in the apprehension of a thief and the recovery of stolen monies, are security dye packs disguised as a strapped bundle of currency bills. Such security dye packs are normally kept in a teller drawer along with actual currency bills and are handed to a robber by the teller during a bank robbery. The top and bottom faces of the security dye pack are concealed by actual currency bills to simulate actual bundles of currency bills. The disguised security dye packs actually conceal metal canisters containing tear gas, visible dye, tracer dye (rare earth oxide), smoke and/or other active chemicals which can be discharged from the security dye pack to assist in the recovery of stolen monies; and to assist in the apprehension of an assailant.

Tear gas helps to hinder the robber, making it more difficult for the robber to escape from the scene of the crime. Dye serves to stain any bills in the vicinity of the security dye pack, making such bills unspendable and easier to trace; the dye also may stain the skin and clothing of the robber, making it easier for authorities to identify the robber. Smoke provides a visible signal for authorities to follow to help locate the robber and the stolen funds. In addition, such security dye packs often emit a loud bang upon being expended, tending to confuse the robber and aiding authorities in apprehending the robber.

Metal canisters are commonly used to contain the active chemicals that are emitted by the security dye pack after being ignited. The chemical mixture contained in such security dye packs typically includes combustion chemicals similar to those used in a flare; once ignited, these chemicals burn for approximately one minute. High temperatures are created when the active chemicals are ignited by a heat-generating electrically-actuated squib. The walls of the metal canister help to contain heat that might otherwise cause the security pack to catch fire and become engulfed in flames. Clearly, the danger of fire within banks and other financial institutions is a risk that must be minimized. However, the metal canisters are also relatively thick and rigid.

Several methods have been used to actuate such security dye packs upon unauthorized removal from a protected premises. For example, some security dye packs are normally kept in the teller drawer on a magnetic keeper plate. A magnetic reed switch within the security dye pack disables the unit from detonating so long as the reed switch is within the influence of the magnetic field of the keeper plate. Once removed from the keeper plate, a timer is activated, and when the timer has reached a predetermined count, the canisters are activated to deploy the active chemical agents. Another variety of such security dye packs includes a plug anchored by a pull wire to the teller drawer; removal of the security dye pack from the teller drawer causes the plug to be removed from the unit, thereby arming the device. Such security dye packs are generally described, for example, within U.S. Pat. No. 3,303,592 issued to Harner; and within U.S. Pat. No. 3,424,122 issued to De Angelis.

More sophisticated security dye packs contain miniature radio receivers which are tuned to receive a localized radio signal broadcasted by an antenna in the vicinity of the entry doors to the bank. The transmitted signal is limited to the vicinity of the doors and does not normally extend to the teller area. If a security dye pack is handed to a robber and is thereafter brought into the field of the broadcasted radio signal, the transmitted signal is detected by the radio receiver to arm the security dye pack. The security dye pack may then immediately be detonated, or a time delay circuit can hold off detonation of the chemical canisters for a predetermined amount of time to permit the robber to first exit the premises. Modern security dye packs often include a hold-off circuit preventing the security dye pack from being detonated until the robber has left the field of the transmitted signal. In addition, modern security systems often employ digital coding techniques to minimize the likelihood of inadvertent detonation due to stray radio signals generated by other electronic equipment within the banking environment. Examples of such radio-activated security dye packs are those generally described within U.S. Pat. No. 3,564,525, issued to Robeson, et al., and reissued as Reissue U.S. Pat. No. Re. 27,618; U.S. Pat. No. 3,781,860 issued to Freyling, Jr.; U.S. Pat. No. 3,828,341 issued to Carter, Jr., et al.; U.S. Pat. No. 4,511,888 issued to Bernhardt: U.S. Pat. No. 4,559,529 issued to Bernhardt; and U.S. Pat. No. 4,604,607 issued to Sanderford, Jr., et al.

Unfortunately, as the technology of such security dye packs advances, so does the knowledge and experience of assailants. For example, older security dye packs had relatively rigid edges that could not be fanned to see the edges of individual bills. Accordingly, robbers could easily detect a security dye pack by fanning the edges of each currency bundle. Modern security systems use actual currency bills loosely sewn together for allowing the edges to be fanned by a robber without alerting the robber to the true nature of the security dye pack.

Moreover, the metal canisters containing the active chemicals and related electronic components and circuit board within such security systems are usually relatively rigid. The security dye pack would therefore have a hard, rather than soft, feel when handled. In the past, such security dye packs would make a distinctive sound when the security dye pack is rapped upon a teller counter. Experienced bank robbers have been known to rap currency bundles upon the teller counter before leaving the bank to detect the true identity of a security dye pack, and to leave the security dye pack within the bank before making their escape. This problem has largely been dealt with in the past by placing thin foam cushions above and below the rigid components within the security dye pack to cushion such rigid components when the unit is rapped on a hard surface.

Another method which has been used by knowledgeable robbers to quickly determine whether a bundle of currency is genuine is to bend the bundle of bills. An actual bundle of currency bills is flexible enough to be bent along the central portion thereof toward a U-shaped configuration. On the other hand, due to the rigid metal canisters and circuit boards hidden inside most security dye packs, such units can not easily be bent about their centers. Knowledgeable robbers have been known to test currency bundles handed to them by a teller/cashier by bending such bundles to quickly detect any bogus bundles.

ICI Aerospace Division of ICI Americas Inc., based in Valley Forge, Pa., has introduced a security dye pack under the registered trademark "SecurityPac", available as Part No. PN 50000443, also known as the "FlexPac", wherein a single, relatively large, rigid metal chemical canister is positioned within the central portion of the security dye pack. Rigid circuit boards are positioned upon opposing sides of the chemical canister and are connected to each other by a flexible mylar interconnect strap having electrical conductors embedded therein. A first bendable joint is formed between the canister and the first rigid circuit board on a first side of the canister. A second bendable joint is formed between the canister and the second rigid circuit board on the opposing second side of the canister. In this manner, the resulting security dye pack can be bent into a generally S-shaped structure. This commercial product appears to correspond with the device described in issued U.S. Pat. No. 5,059,949 issued to Caparoni et al. and assigned to ICI Americas Inc. The aforementioned "FlexPac" security dye pack is generally more flexible than past security dye packs; however, such "FlexPac" security dye packs are unable to be bent upon their centers since the rigid chemical canister is positioned squarely in the middle of the unit.

Accordingly, it is an object of the present invention to provide a security dye pack disguised as a bundle of currency bills for assisting in the apprehension of a robber, and in the recovery of stolen monies from a protected premises, wherein such security dye pack eliminates the need for rigid metal chemical canisters, and thereby allows the security dye pack to have a softer feel.

It is a further object of the present invention to provide such a security dye pack which is largely flexible along a significant portion of its length to facilitate bending of the unit.

A still further object of the present invention is to provide such a security dye pack which more closely resembles the feel of an actual bundled stack of bills to help avoid detection by knowledgeable thieves.

Yet another object of the present invention is to provide such a security dye pack which does not present a significant risk of fire when the security dye pack is ignited.

These and other objects of the present invention will become more apparent to those skilled in the art as the description thereof proceeds.

SUMMARY OF THE INVENTION

Briefly described, and in accordance with a preferred embodiment thereof, the present invention relates to a security dye pack disguised as a bundle of currency bills for discharging active chemicals to assist in the apprehension of an assailant and in the recovery of monies stolen from a protected premises, and including a housing resembling a bundle of currency bills and having a hollowed inner chamber. A substrate, which may be in the form of a printed circuit board, is disposed within the hollowed inner chamber of the housing for supporting electronic circuitry used to detect the removal of the security dye pack from the protected premises and to generate an actuating electrical signal in response thereto. A flexible container is also disposed within the hollowed inner chamber of the housing. An electrically-activated squib is coupled to the electronic circuitry and extends into the flexible container, the squib being responsive to the actuating electrical signal for generating heat. A chemical mixture is disposed within the flexible container and is adapted to be ignited by heat generated by the squib for discharging active chemicals, such as tear gas, smoke, and dye, from the housing. Preferably, the flexible container is relatively soft and bendable to avoid significant stiffening of the housing, and to help prevent detection by an assailant.

The substrate may either be a conventional rigid printed circuit board or a more flexible conductive substrate. Assuming that the substrate is a relatively rigid circuit board, then the length of the printed circuit board is preferably shorter than the length of the hollowed inner chamber of the housing to lessen interference with the bending of the security dye pack.

The security dye pack also preferably includes a battery pack secured to the substrate for supplying electrical power to the electronic circuit.

The aforementioned squib may be soldered, or otherwise electrically connected, to a peripheral edge of the printed circuit board. The flexible container is itself sealed to the peripheral edge of the circuit board, and the squib extends from the peripheral edge of the circuit board into the chemical mixture contained by the flexible container.

As indicated above, the danger of fire resulting from the burning of the chemical mixture must be minimized. Accordingly, the flexible container that contains the chemical mixture is formed of flexible, heat-resistant material to prevent the housing from burning due to the ignition of the chemical mixture by the squib. The flexible container is advantageously formed of a sheet of heat resistant film folded over itself and joined along overlapping edges to form a flexible pouch. The overlapping edges of the heat resistant film may be joined and sealed to each other by an adhesive strip of heat resistant tape.

The printed circuit board itself may also be surrounded by a heat-resistant film to prevent the circuit board, and/or components mounted thereto from burning once the chemical mixture is ignited. In the preferred embodiment, the heat resistant film that surrounds the printed circuit board is simply a continuation of the-heat resistant film used to forming the flexible pouch containing the chemical mixture.

As indicated above, foam pads positioned above and below the rigid contents of the hollowed inner chamber of the housing have been used in the past to cushion such contents. However, the extreme heat generated when the chemical mixture contained by the flexible chemical pouch is ignited could easily melt such foam pads and/or cause such foam pads to break out in flames. To prevent such occurrence, the security dye pack of the present invention preferably includes a first layer of cushioning material disposed within the hollowed inner chamber below the substrate, and a second layer of cushioning material disposed within the hollowed inner chamber above the substrate, each of the first and second layers of cushioning material being covered by a heat-resistant film. The heat resistant film applied to the first and second layer of cushioning material serves to prevent the first and second layers of cushioning material from melting or burning due to the ignition of the chemical mixture by the squib. The heat resistant film does not interfere with the cushioning function of such layers, but protects such layers from excessive heat.

In order to retain the first and second cushioning layers in place within the hollowed inner chamber even when the security dye pack is flexed, a first plastic sheet is preferably secured to the housing and extends across the hollowed inner chamber of the housing below the first layer of cushioning material. This first plastic sheet serves to maintain the substrate, battery pack, flexible container and first layer of cushioning material within the hollowed inner chamber of the housing, and prevents such components from popping out of one side of the housing. Likewise, a second plastic sheet is secured to the housing and extends across the hollowed inner chamber of the housing above the second layer of cushioning material to maintain the substrate, battery pack, flexible container and second layer of cushioning material from popping out of the opposite side of the housing. The first and second plastic sheets have holes formed therein for being engaged with the elastic threads that extend through corresponding holes formed in the housing in order to hold the bundle of bills together. In this manner, the first and second plastic sheets are secured to the housing. Preferably, the first and second plastic sheets are heat-tempered to prevent the housing from burning due to the ignition of the chemical mixture by the squib.

BRIEF DESCRIPTION OF THE DRAWINGS

FIG. 1 is a perspective view of a security dye pack constructed in accordance with the teachings of the present invention, and wherein an actual ten dollar bill covering the upper face of the security dye pack has been raised to reveal a hollowed inner chamber.

FIGS. 3A–3D show a step-by-step process for forming a flexible, heat-resistant container for containing a chemical mixture disposed within the hollowed inner chamber of the security dye pack as shown in FIG. 2.

DETAILED DESCRIPTION OF THE PREFERRED EMBODIMENT

Figure 2:
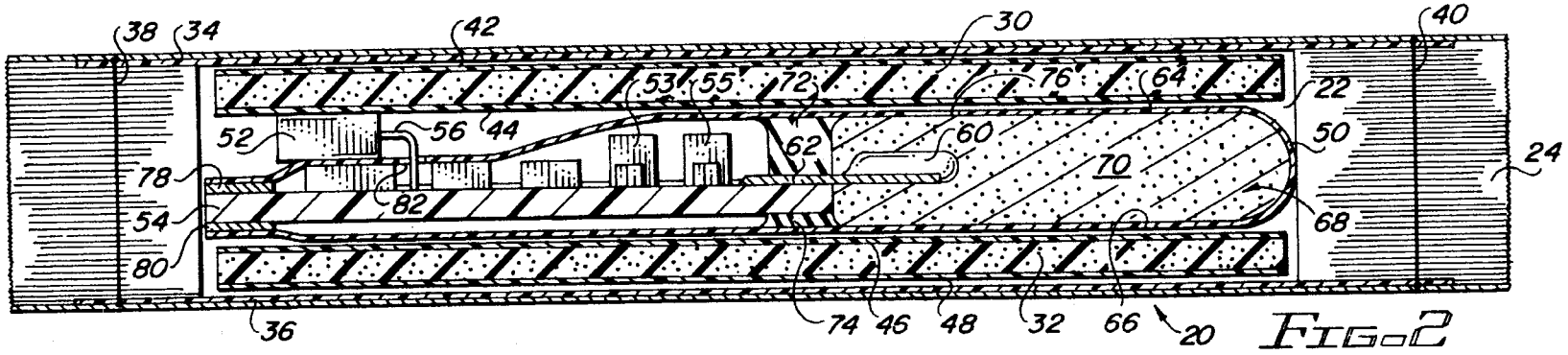
FIG. 2 is a sectional view of the security dye pack shown in FIG. 1 taken through the plane designated by lines 2—2 within FIG. 1, and illustrating a printed circuit board, a battery pack, a flexible chemical mixture container, and heat-protected foam cushions.

In FIG. 1, a security dye pack constructed in accordance with the teachings of the present invention is designated generally by reference numeral 20. As shown in FIG. 1, security dye pack 20 is disguised as a bundle of currency bills. The bundle of currency bills is hollowed out to form an inner rectangular chamber 22, and the hollowed bundle of currency bills thereby forms a housing 24. Housing 24 is preferably formed from actual treasury bills with their center portions removed to form hollow inner chamber 22. The upper face of security dye pack 20 is covered by an actual currency bill 26. Similarly, the lower face of security dye pack 20 is covered by a similar actual currency bill 28. Actual currency bills 26 and 28 are secured to housing 24 by a strap 28 of the same type ordinarily used to strap together bundles of currency bills.

Also visible within FIG. 1 is a thin cushioning layer of foam rubber 30 disposed adjacent the top side of inner chamber 22. As noted above, foam layer 30 cushions the components housed within inner chamber 22 if security dye pack 20 is rapped against a teller counter or other hard surface. This cushioning foam may be an open-cell foam commercially available from Bron Tapes of Phoenix, Ariz. A similar layer of cushioning foam 32 (see FIG. 2) is disposed adjacent the bottom side of inner chamber 22 to similarly cushion the components disposed within inner chamber 22 against impact with the bottom portion of security dye pack 20.

Foam layer 30 is retained within inner chamber 22 by a transparent plastic cover sheet 34 which overlies inner chamber 22 of housing 24. Transparent plastic cover sheet 34 is preferably inserted below the upper two or three currency bills of housing 24; this method of assembly is sufficient to retain plastic cover sheet 34 in place while still allowing plastic cover sheet 34 to bend easily. Likewise, a similar transparent plastic cover sheet 36 (see FIG. 2) extends over the bottom face of inner chamber 22 and retains lower foam layer 32 therein. Lower cover sheet 36 is preferably inserted above the lower two or three currency bills of housing 24. Lower plastic cover sheet 36 serves to prevent the components contained within inner chamber 22 of housing 24 from falling out the bottom of security dye pack 20, even when the unit is flexed. Cover sheets 34 and 36 are preferably formed of a heat-tempered, heat-resistant plastic to withstand and help distribute heat generated within security dye pack 20 following ignition thereof, and to help prevent housing 24 from burning due to the ignition of the chemical mixture therein.

Still referring to FIGS. 1 and 2, , a pair of holes (e.g., 37 and 39) are drilled through the bundle of bills at each end thereof, and elastic cords 38 and 40 are threaded through such holes to loosely fasten the bills to one another as a bundle; this method of attachment permits the edge portions of security dye pack 20 to be fanned, and thereby simulate the look and feel of actual strapped bundles of currency. As shown in FIGS. 1 and 2, elastic threads 38 and 40 also pass through corresponding holes formed in transparent plastic cover sheets 34 and 36 to retain plastic cover sheets 34 and 36 in place.

Upper and lower foam cushioning layers 30 and 32 are lightweight and provide sufficient cushioning. However, such foam layers have limited heat tolerance, and when exposed to relatively high temperatures, such foam melts and burns. As shown in FIGS. 1 and 2, upper foam cushioning layer 30 is covered on its upper face by a first layer of heat-resistant film 42, and is covered on its lower face by a second layer of heat-resistant film 44. Likewise, lower foam cushioning layer 32 is covered on its upper face by a first layer of heat-resistant film 46, and is covered on its lower face by a second,layer of heat-resistant film 48. This heat-resistant film is preferably of the type commercially available from E. I. DuPont under the brand name "KAPTON", has a thickness of 0.002 inch, and is attached to the faces of the cushioning foam by an adhesive. The above-described KAPTON film is commercially available in a form having such adhesive already applied to one face of such film. Applicant has found that, by protecting cushioning foam layers 30 and 32 with such heat-resistant film, the heat generated during ignition of security dye pack 20 can still melt the foam, but the foam does not burn.

Also visible within the cutaway portion of FIG. 1 is yet another heat resistant film designated generally by reference numeral 50. Heat-resistant film 50 serves to form a flexible pouch for containing the active chemical mixture, and also serves to protect a printed circuit board from heat, in a manner described in greater detail below. Also seen in the cutaway portion of FIG. 1 is a battery pack 52 which extends just above heat-resistant film 50, and which is releasably connected with the printed circuit board for supplying electrical power thereto.

The basic working components housed within inner chamber 22 are visible within the cross-sectional drawing of FIG. 2. All electrical components, such as devices 53 and 55, are mounted to a substrate, such as printed circuit board 54. Such electrical components represent integrated circuits, resistors, capacitors, SCRs, and the like. It will be noted from FIG. 2 that the length of printed circuit board 54 is significantly shorter than the length of hollowed inner chamber 22 of housing 24; accordingly, printed circuit board 54 does not significantly stiffen security dye pack 20.

Extending upwardly from printed circuit board 54 are a pair of semi-rigid electrical leads 56 and 58, the upper ends of which releasably plug into mating jacks of battery pack 52 for allowing battery pack 52 to be releasably interconnected with printed circuit board 54. Battery pack 52 supplies electrical power to the electronic components mounted to printed circuit board 54. The internal structure of battery pack 52 is described in greater detail within U.S. Pat. No. 5,196,828 issued to the present applicant and assigned to the assignee of the present invention; the specification and drawings of such patent are hereby incorporated by reference. When such electrical components are properly interconnected, they form an electronic circuit means for detecting removal of security dye pack 20 from a protected premises in order to generate an actuating electrical signal in response thereto. The specific manner in which such components function is described in greater detail herein in conjunction with FIGS. 4–7.

Still referring to FIG. 2, squib 60 is shown extending from a peripheral portion of printed circuit board 54. Squib 60 includes a pair of electrical leads 62 that are soldered to a corresponding pair of terminals on the upper face of printed circuit board 54. Squib 60 is electrically coupled to the electronic components mounted to printed circuit board 54 and is responsive to the generation of the actuating electrical signal for generating heat to ignite the active chemical mixture within security dye pack 20. Squib 60 includes a gelatin capsule containing pyrotechnics, for example, Pyrodex-brand gunpowder for causing a small explosion when an electrical current is conducted through squib 60 by electrical leads 62.

As mentioned above, heat-resistant film 50 is used to form a flexible container or pouch in order to contain the active chemical mixture within hollowed inner chamber 22 of housing 24 and to prevent housing 24 from burning due to the ignition of the chemical mixture by squib 60. Within FIG. 2, heat-resistant film 50 is shown in cross-section as being folded back over itself. Heat-resistant film 50 includes an upper sheet 64 extending above printed circuit board 54 and an opposing lower sheet 66 extending below printed circuit board 54. While not discernible within FIG. 2, the overlapping edges of upper sheet 64 and lower sheet 66 are joined to each other to form a pouch.

Heat-resistant film 50 is preferably a sheet of the above-described "KAPTON" film. Upper sheet 64 and lower sheet 66 define a flexible pouch 68 extending to the right (relative to FIG. 2) of printed circuit board 54. Flexible pouch 68 is charged with a chemical mixture 70 including gunpowder, tear gas powder, visible chemical dye, a tracer dye in the form of a rare earth oxide, and smoke powder. Those skilled in the art will appreciate that flexible pouch 68, including chemical powder mixture 70, is relatively soft and bendable in comparison with rigid metal canisters normally used to contain the active chemical mixture. Flexible pouch 68 avoids significant stiffening of housing 24, and thereby helps to prevent detection of security dye pack 20 by an assailant.

As shown in FIG. 2, squib 60 extends into pouch 68 and into chemical mixture 70. An upper bead of clear silicone RTV sealant 72 seals upper sheet 64 of heat-resistant film 50 to the upper face of the peripheral edge of printed circuit board 54, while permitting electrical leads 62 of squib 60 to pass therethrough. A similar lower bead of clear silicone RTV sealant 74 seals lower sheet 66 of heat-resistant film 50 to the lower face of the peripheral edge of printed circuit board 54 to completely enclose chemical mixture 70. A small rectangular-shaped aperture 76 is formed in upper sheet 64 of heat-resistant film 50 to emit tear gas, smoke and dye following ignition of chemical mixture 70. Aperture 76 may be covered with a length of conventional clear adhesive tape (not shown) to prevent chemical mixture 70 from leaking through aperture 76 prior to ignition of chemical mixture 70.

Chemical mixture 70 is adapted to be ignited by heat generated by squib 60 for discharging active chemicals from housing 24 of security dye pack 20. Squib 60 contains an ignition mix which burns when an electrical current is conducted through electrical lead wires 62. The burning ignition mix chemically activates the tear gas, smoke and dye powder within chemical mixture 70, which is then rapidly discharged outwardly through aperture 76. Because the currency bills forming housing 24 are loosely held together by elastic threads 38 and 40, housing 24 is relatively permeable to the passage of dye, smoke, tear gas and/or other active chemicals therethrough.

Still referring to FIG. 2, upper sheet 64 and lower sheet 66 of folded heat-resistant film 50 extend fully over and under, respectively, printed circuit board 54. The left-most edge of upper sheet 64 (relative to FIG. 2) is secured by a length of double-faced polyester heat tape 78 to the upper face of the left-most edge of printed circuit board 54. Likewise, the left-most edge of lower sheet 66 is secured by a length of double-faced polyester heat tape 80 to the lower face of the left-most edge of printed circuit board 54. Suitable double-faced heat tape is commercially available from Bron Tape of Phoenix, Ariz. as Bron Part No. 3854. While not shown in FIG. 2, the side edges of upper sheet 64 and lower sheet 66 are sealed together to form a heat-resistant container, in the form of a film, that surrounds printed circuit board 54 and the electrical components mounted thereto. Only battery pack 52 lies outside such heat resistant film, and suitable holes 82 are formed within upper sheet 64 to permit semi-rigid electrical leads 56 and 58 to extend therethrough for coupling with battery pack 52. Thus, the heat resistant upper sheet 64 and heat resistant lower sheet 66 are merely a continuation of the heat-resistant film used to form pouch 68 for chemical mixture 70. The heat resistant film covering printed circuit board 54 and the components mounted thereto helps to prevent either the printed circuit board or attached electrical components from burning or flaming following ignition of chemical mixture 70.

A preferred method of forming heat-resistant pouch 68 will now be described in regard to FIGS. 3A–3D. In FIG. 3*a*, a film 50 of KAPTON-brand heat-resistant material is shown with apertures 76 and 82 already formed therein. Aperture 76 is the opening through which the active chemicals are emitted following ignition of chemical mixture 70, and holes 82 permit the battery pack connection leads 56 and 58 to extend therethrough. A center fold line 84 is also shown. The overall length of film 50, as shown in FIG. 3A, is slightly greater than twice the length of inner chamber 22 of housing 24, and the width of film 50 is slightly less than the width of inner chamber 22.

As shown in FIG. 3B, film 50 is bent back upon itself generally over fold line 84 to provide upper sheet 64 and lower sheet 66. Then, as shown in FIGS. 3C and 3D, a pair of strips 86 and 88 of single-sided adhesive heat tape, of the type described above, are applied along the overlapped side edges of upper sheet 64 and lower sheet 66 to secure and seal such overlapped side edges to each other. Hole 76 is closed with a piece of conventional adhesive tape, as described above, and chemical mixture 70 is then charged within the pouch 68 formed near fold line 84. Printed circuit board 54 is then inserted between sheets 64 and 66, with squib 60 extending into chemical mixture 70. The RTV sealant is then applied to seal pouch 68 to the innermost edge of printed circuit board 54. The outermost edges of sheets 64 and 66 are then secured to the outermost edge of printed circuit board 54 with heat tape, and finally, the battery pack 52 is attached, in the manner described above.

Figure 5:
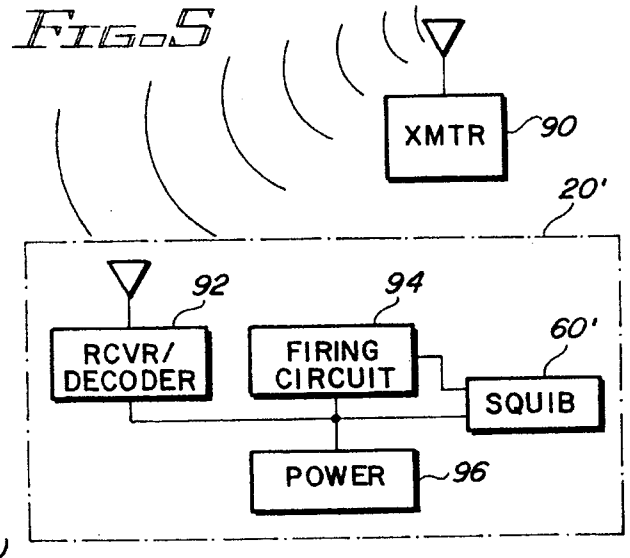
FIG. 5 is a simplified block diagram showing a transmitter located near the exit doors of the premises to be protected, as well as the electrical components housed within the security dye pack of FIGS. 1 and 2.
Figure 4:
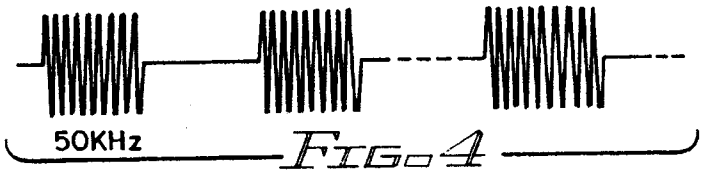
FIG. 4 is a waveform diagram illustrating the pulsed 50 KHz. signal transmitted by a transmitter to which the security dye pack is responsive.

The use of security dye pack 20 will now be briefly described in conjunction with FIGS. 4 and 5. The dashed block 20' within FIG. 5 represents security dye pack 20, while transmitter 90 indicates a radio-frequency transmitter located near the exit door of the premises to be protected. Transmitter 90 includes an antenna that surrounds the exit door of the premises to be protected. As shown in FIG. 4, the radio frequency signal transmitted by the antenna of transmitter 90 is a 50 KHz. signal that is pulsed on and off at a predetermined rate. The field of the transmitted 50 KHz. signal is localized to the vicinity of the exit door and does not extend as far as the area of the teller drawers or other areas where money is normally kept within the protected premises.

Within dashed block 20' of FIG. 5, a receiver/decoder circuit 92 detects the receipt of the proper coded/pulsed radio frequency signal transmitted by transmitter 90. Dashed block 20' also includes a firing circuit 94 responsive to receiver/decoder circuit 92 for sending an electrical current through squib 60'. Dashed block 20' also includes power source 96, corresponding to battery pack 52.

Figure 6:
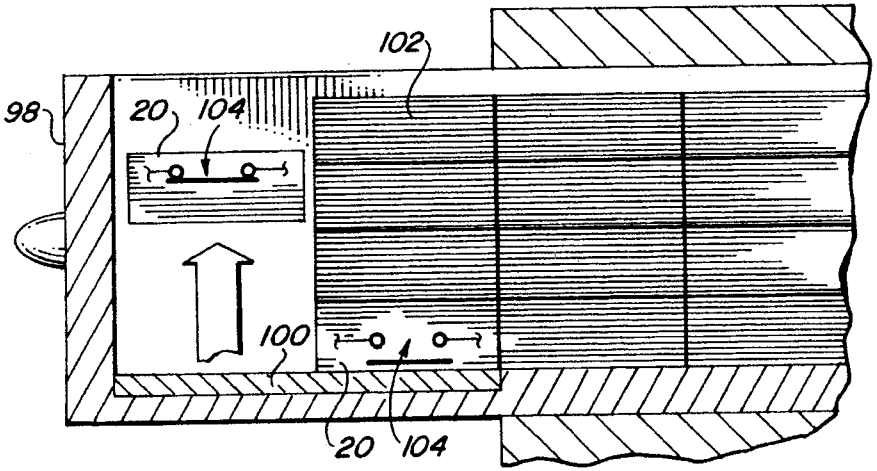
FIG. 6 is a sectional side view of a bank teller drawer showing a magnetic keeper plate for disabling the battery of the security dye pack until the security dye pack is removed from the teller drawer.

To minimize the drain of electrical power from battery pack 52, and to lessen the likelihood of an unintended ignition of security dye pack 20, a magnetically-actuated reed switch may be provided to disconnect the battery whenever security dye pack 20 is resting within a teller drawer of a bank or other financial institution. Referring to FIG. 6, teller drawer 98 includes a magnetic keeper plate 100 on the floor thereof. Security dye pack 20 normally rests upon keeper plate 100 within teller drawer 98, along with actual bundles of currency 102. Security dye pack 20 includes a magnetically-actuated reed switch 104 which is normally an open circuit when under the influence of a strong magnetic force proximate keeper plate 100. This open circuit disconnects the battery from the other electrical components housed within security dye pack 20. However, when security dye pack 20 is removed from teller drawer 98, and leaves the magnetic field proximate keeper plate 100, reed switch 104 closes, allowing battery pack 52 to apply electrical power to the other electronic components within security dye pack 20.

Figure 7:
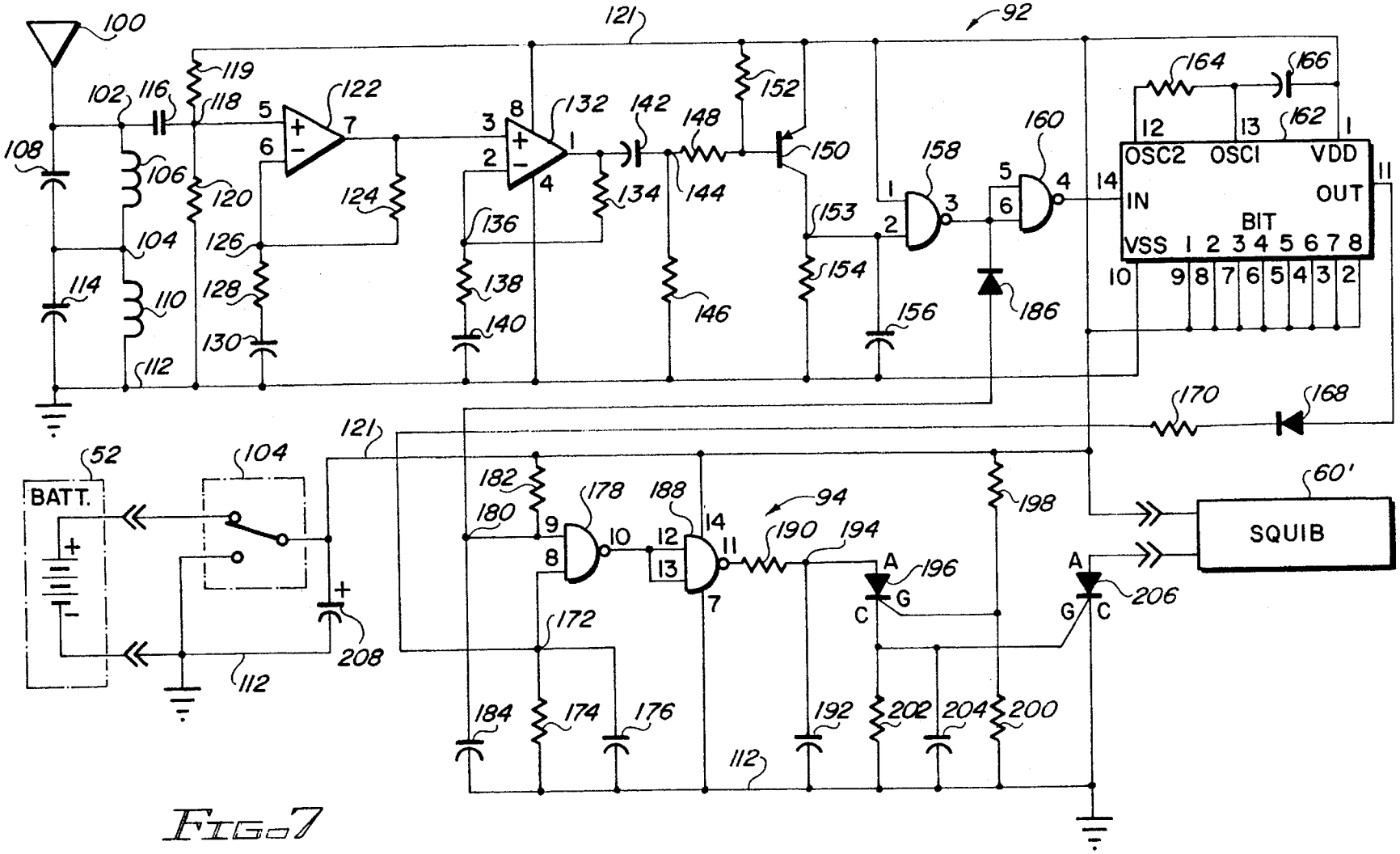
FIG. 7 is a circuit schematic of the electrical components supported upon the aforementioned printed circuit board for igniting the chemical mixture in order to discharge tear gas, smoke, and dye from the security dye pack upon detecting removal of the security dye pack from a protected premises.

FIG. 7 is a circuit schematic of the radio receiver components and other electronic components collectively responsible for detecting the removal of the security dye pack from the protected premises and discharging the tear gas, smoke, dye and/or other active chemicals from pouch 68. It will be recalled from FIG. 5 that security dye pack 20' includes a receiver decoder circuit 92; this receiver/decoder circuitry includes the components shown in the upper half of the schematic of FIG. 7, and is designated generally by reference numeral 92 within FIG. 7. Receiver/decoder 92 is designed to receive the pulsed radio frequency signal of 50 KHz. transmitted by radio transmitter 90, as described above in regard to FIG. 5. The transmitted 50 KHz. signal is preferably transmitted in a predetermined binary code which may be impressed upon the carrier signal by known on-off keying techniques. The binary code impressed upon the 50 KHz. carrier signal includes streams of data bits, each stream being of the same duration and including eight data bits. The streams are separated from one another by a set interval, the interval preferably being equal to the duration of one stream of eight data bits. Receiver/decoder circuitry 92 checks to determine whether it has received eight such streams of eight data bits each. If so, receiver/decoder circuitry 92 recognizes the received signal as being the proper signal rather than being a stray signal received from other equipment within the protected premises.

The front end of receiver/decoder 92 includes an antenna 100 coupled to node 102 which leads to a tuned inductive-capacitive network. Node 102 is coupled to intermediate node 104 by inductor 106; capacitor 108 is coupled in parallel with inductor 106. A second inductor 110 is coupled between node 104 and ground conductor 112; a second capacitor 114 is coupled in parallel with second inductor 110. The values of inductors 106 and 110 and capacitors 108 and 114 are selected to tune the receiver for maximum sensitivity at 50 KHz.

Node 102 is coupled through capacitor 116 to node 118, and node 118 is coupled through resistor 119 to positive voltage supply conductor 121 and through resistor 120 to ground conductor 112. Positive supply conductor 121 provides a voltage of six volts derived from battery pack 52 coupled through reed switch 104, as explained above in conjunction with FIG. 6. Node 118 is also coupled to the non-inverting input terminal (pin 5) of a first operational amplifier 122, which may be of the type commercially available from National Semiconductor under Part No. LM358D. The output terminal (pin 7) of first op amp 122 is coupled by feedback resistor 124 to node 126; node 126 is connected to the inverting input terminal (pin 6) of op amp 122 to provide negative feedback thereto. Node 126 is also coupled through series-connected resistor 128 and capacitor 130 to ground conductor 112. The R-C time constant for resistor 128 and capacitor 130 is selected to maximize the sensitivity of op amp 122 to input signals having a frequency of 50 KHz.

The output of op amp 122 is also provided to the non-inverting input terminal (pin 3) of a second operational amplifier 132, which may also be of the type commercially available from National Semiconductor under Part No. LM358D. Preferably, op amps 122 and 132 are provided within the same integrated circuit package. As indicated in FIG. 7, the positive supply terminal (pin 8) of such integrated circuit is coupled to positive voltage supply conductor 121, and the ground supply terminal (pin 4) is coupled to ground conductor 112. The output terminal (pin 1) of second op amp 132 is coupled by feedback resistor 134 to node 136; node 136 is connected to the inverting input terminal (pin 2) of op amp 132 to provide negative feedback thereto. Node 136 is also coupled through series-connected resistor 138 and capacitor 140 to ground conductor 112. Once again, the R-C time constant for resistor 138 and capacitor 140 is selected to maximize the sensitivity of op amp 132 to input signals having a frequency of 50 KHz.

The output signal generated by second op amp 132 is coupled through capacitor 142 to node 144 within a resistive divider biasing network. Resistor 146 extends from node 144 to ground conductor 112. Node 144 is coupled through base resistor 148 to the base of PNP transistor 150. Pull-up resistor 152 is coupled between positive voltage supply conductor 121 and the base of transistor 150. The emitter of transistor 150 is coupled to positive voltage supply conductor 121. The values for resistors 146, 148, and 152 are selected to barely conduct any bias current through the base of transistor 150 under static d.c. conditions. Accordingly, in the absence of the 50 KHz. signal, transistor 150 is essentially non-conductive.

The collector of transistor 150 is coupled to node 153 by a relatively large-valued load resistor 154 to ground conductor 112, and capacitor 156 is coupled in parallel therewith. Resistor 154 and capacitor 156 have a characteristic R-C time constant that is slower than the period of the 50 KHz. signal transmitted by transmitter 90. When a 50 KHz. signal is being received, transistor 150 is switched between conductive and non-conductive states during each period of the 50 KHz. signal. During the portion of each period when transistor 150 is conductive, capacitor 156 is charged by the current conducted by the collector of transistor 150; during the portion of each period when transistor 150 is non-conductive, the charge previously stored in capacitor 156 begins to decay through resistor 154, but does not fully discharge before transistor 150 is again rendered conductive. As a result, node 153 charges toward the positive supply voltage during the time that the transmitted 50 KHz. signal is gated on. When no 50 KHz. signal is present, as when the transmitted carrier signal is gated off, node 153 discharges to ground.

Thus, the output signal developed at node 153 is a filtered digital signal that goes high when the 50 KHz. signal is gated on, and that goes low when the 50 KHz. signal is gated off. The output signal developed at node 153 is coupled to one input terminal (pin 2) of NAND gate 158 which may be of the type commercially available from Motorola under Part No. MC14093B as a quad NAND integrated circuit. The second input terminal (pin 1) of NAND gate 158 is coupled to the positive voltage conductor 121 for causing NAND gate 158 to function as a logical invertor. The output signal provided by NAND gate 158 (at pin 3) is coupled to both input terminals (pins 5 and 6) of a second NAND gate 160, which similarly functions as an invertor. The output signal generated at the output terminal (pin 4) of NAND gate 160 is of the same phase as the filtered signal developed at node 153, but has much sharper rising and falling edges.

The output of NAND gate 160 is coupled to the data input terminal (pin 14) of integrated circuit decoder chip 162 commercially available from Linear under Part No. R800. Integrated circuit 162 is a low power CMOS chip which includes a positive supply terminal (pin 1) that is coupled to the positive supply conductor 121, and a negative supply terminal (pin 10) that is coupled to ground conductor 112. Integrated circuit 162 includes eight digital input terminals (pins 2–9) used to program a digital code; as shown in FIG. 7, all of such digital input terminals are coupled to positive supply conductor 121 for effectively programming a binary input code of "11111111". Integrated circuit 162 also includes a pair of frequency tuning terminals ( pins 12 and 13) for selecting the frequency of the incoming digital signal. As shown in FIG. 7, resistor 164 is coupled between pins 12 and 13, and capacitor 166 is coupled between pin 13 and positive supply pin 1. The R-C time constant established by resistor 164 and capacitor 166 tunes decoder chip 162 to a 50 KHz. input signal.

Once decoder chip 162 detects the correct incoming code sequence (in this case, eight consecutive gated transmissions of the 50 KHz. signal), it provides a logic high level at the output terminal (pin 11). Output pin 11 is coupled through a diode 168 and resistor 170 to node 172 of firing circuit portion 94. Node 172 is coupled to an R-C charging network formed by resistor 174 and capacitor 176, both of which are coupled between node 172 and ground conductor 112. If output pin 11 of decoder circuit 162 is low, then diode 168 does not conduct, and resistor 174 discharges capacitor 176 to ground potential. However, once pin 11 of decoder circuit 162 goes high, indicating receipt of the proper code, then diode 168 is rendered conductive, and capacitor 176 and, hence, node 172, are charged to a positive voltage through resistor 170.

Node 172 is coupled to an input terminal (pin 8) of NAND gate 178. The second input terminal (pin 9) of NAND gate 178 is coupled to node 180; node 180 is coupled through pull-up resistor 182 to the voltage supply conductor 121, and is also coupled to ground through capacitor 184. Node 180 is also coupled to the output terminal (pin 3) of NAND gate 158 through diode 186. Thus, when the voltage at the output terminal of NAND gate 158 goes low, diode 186 turns on, discharges capacitor 184, and forces node 180 low. When the voltage at the output terminal of NAND gate 158 returns high, the voltage at node 180 slowly rises as resistor 182 charges capacitor 184.

The output (pin 10) of NAND gate 178 can go low only if both input terminals (pins 8 and 9) are high. Pin 8 will remain high after the output terminal (pin 11) of decoder chip 162 goes high. However, so long as the security dye pack remains in the field of the transmitted signal (i.e., in the vicinity of the exit door), the voltage at node 180 will be discharged each time the 50 KHz. signal is received. Only after the security dye pack leaves the field of the transmitted signal (and the assailant has left the protected premises), will the voltage at node 180 rise to a logic "1" level. Thus, NAND gate 178 and components 182, 184, and 186 provide a hold-off feature which prevents the security dye pack from expending any chemicals until after the assailant leaves the protected premises.

The output of NAND gate 178 is coupled to both input terminals (pins 12 and 13) of a further NAND gate 188 configured as an invertor. The output terminal (pin 11) of NAND gate 188 is coupled to an R-C charging network including resistor 190 and capacitor 192 which are joined at node 194. As the output of NAND gate 188 rises, current flows through resistor 190 and begins to charge capacitor 192, whereby the voltage at node 194 slowly rises. Through proper selection of values of resistor 190 and capacitor 192, a predetermined time delay of, for example, five seconds may be provided to further delay expenditure of the active chemicals for five seconds after the assailant has left the field of the transmitted signal.

Node 194 is coupled to the anode of a silicon-controlled-rectifier (SCR) 196 of part type 2N6028. A voltage divider network including resistors 198 and 200 biases SCR 196 to normally be non-conductive. When the voltage at node 194 rises above a predetermined voltage, SCR 196 breaks down and becomes conductive, thereby sending current through resistor 202 and charging capacitor 204 coupled in parallel therewith. As the voltage across resistor 202 increases, a second SCR 206 of part type 2N5061 breaks down and becomes conductive. As indicated in FIG. 7, SCR 206 conducts an electrical current through the squib 60' to ignite chemical mixture 70 within pouch 68 (see FIG. 2). As indicated in FIG. 7, squib 60' is coupled between the anode of SCR 206 and the positive voltage supply conductor 121.

Within FIG. 7, magnetically-responsive reed switch 104 is illustrated interposed between the positive terminal of +6 Volt battery pack 52 and the positive voltage supply conductor 121. As explained above, reed switch 104 is used to conserve battery power when the security dye pack is kept within a teller drawer for long periods of time. So long as the security dye pack is kept upon the magnetic keeper plate, reed switch 104 uncouples battery pack 52 from voltage supply conductor 121. However, when the security dye pack is lifted from the magnetic keeper plate, as when being handed to an assailant, reed switch 104 closes, thereby coupling electrical power to the circuit components. Reed switch 104 may be of the type commercially available from Hasco under Part No. ORT-233. A filter capacitor 208 extends between the positive supply conductor 121 and ground conductor 112 to filter out any transient signals from the power supply conductors.

Within the preferred embodiment of the present invention, the components not otherwise identified above have the values set forth below:

| component | | value |
|---|---|---|
| resistors: | | (in ohms) |
| 119 | | 100K |
| 120 | | 100K |
| 124 | | 240K |
| 128 | | 4.7K |
| 134 | | 240K |
| 138 | | 7.5K |
| 146 | | 5 Meg |
| 148 | | 20K |
| 152 | | 470K |
| 154 | | 100K |
| 164 | | selected to tune decoder to 50 KHz. |
| 170 | | 10K |
| 174 | | 5 Meg |
| 182 | | 330K |
| 190 | | 390K |
| 198 | | 2.0 Meg |
| 200 | | 2.0 Meg |
| 202 | | 150 |
| capacitors: | | (in microfarads) |
| 108 | | .01 |
| 114 | | .01 |
| 116 | | .1 |
| 130 | | .01 |
| 140 | | .01 |
| 142 | | .01 |
| 156 | | 1000 picofarad |
| 166 | | 220 picofarad |
| 176 | | 10 |
| 184 | | .1 |
| 192 | | 22 |
| 204 | | .01 |
| inductors: | 106/110 | 1 millihenry |
| diodes: | 168/186 | 1N4148 |

-continued

| component | | value |
|---|---|---|
| transistor: | 150 | 2N5087 |

Those skilled in the art will now appreciate that a security dye pack has been described which eliminates the need for rigid metal chemical canisters, and thereby allows the security dye pack to have a softer, and more flexible, feel to make it more difficult for an assailant to determine the true nature of a security dye pack handed to the assailant. The novel security dye pack is adapted to be largely flexible along a significant portion of its length to facilitate bending of the unit. The described security dye pack avoids the need for rigid metal canisters, yet minimizes the risk of fire when the security dye pack is ignited.

While the invention has been described with reference to a preferred embodiment thereof, the description is for illustrative purposes only and is not to be construed as limiting the scope of the invention. Various modifications and changes may be made by those skilled in the art without departing from the true spirit and scope of the invention as defined by the appended claims.

I claim:

1. A security dye pack disguised as a bundle of currency bills for discharging active chemicals to assist in the apprehension of an assailant and in the recovery of monies stolen from a protected premises, said security dye pack comprising in combination:

a. a housing resembling a bundle of currency bills and having a hollowed inner chamber;

b. a substrate disposed within said hollowed inner chamber;

c. electronic circuit means disposed upon said substrate for detecting removal of said security dye pack from the protected premises and generating an actuating electrical signal in response thereto;

d. a squib coupled to said electronic circuit means and responsive to said actuating electrical signal for generating heat to ignite chemicals;

e. a heat resistant flexible container disposed within the hollowed inner chamber of said housing, said squib extending into said flexible container; and f. a chemical mixture comprising active chemicals disposed within said flexible container and adapted to be ignited by heat generated by said squib for discharging active chemicals from said housing to assist in the apprehension of the assailant and in the recovery of stolen monies;

g. said flexible container being relatively soft and bendable by comparison with a rigid metal chemical canister.

2. A security dye pack as recited by claim 1 further including a first layer of cushioning material disposed within the hollowed inner chamber below said substrate, and including a second layer of cushioning material disposed within the hollowed inner chamber above said substrate, each of said first and second layers of cushioning material being covered by a heat-resistant film to prevent said first and second layers of cushioning material from burning due to the ignition of said chemical mixture by said squib.

3. A security dye pack as recited by claim 2 including a first plastic sheet secured to said housing and extending across the hollowed inner chamber of said housing below said first layer of cushioning material to maintain said substrate, flexible container and first layer of cushioning material within the hollowed inner chamber of said housing, and including a second plastic sheet secured to said housing and extending across the hollowed inner chamber of said housing above said second layer of cushioning material to maintain said substrate, flexible container and second layer of cushioning material within the hollowed inner chamber of said housing.

4. A security dye pack as recited by claim 3 wherein said first and second plastic sheets have holes formed therein, and wherein said security dye pack includes elastic threads extending through the holes of said first and second plastic sheets to secure said first and second plastic sheets to said housing.

5. A security dye pack as recited by claim 3 wherein said first and second plastic sheets are heat-tempered to prevent said housing from burning due to the ignition of said chemical mixture by said squib.

6. A security dye pack as recited by claim 1 wherein said flexible container is formed of a layer of a heat-resistant material to prevent said housing from burning due to the ignition of said chemical mixture by said squib.

7. A security dye pack as recited by claim 6 wherein said printed circuit board is surrounded by a heat-resistant film.

8. A security dye pack as recited by claim 7 wherein said heat resistant film surrounding said printed circuit board is a continuation of the walls forming said flexible container.

9. A security dye pack as recited by claim 6 wherein said flexible container is formed of a sheet of heat resistant film folded over itself and joined along overlapping edges to form a pouch.

10. A security dye pack as recited by claim 9 wherein the overlapping edges of said sheet of heat resistant film are joined by an adhesive strip of heat resistant tape.

11. A security dye pack as recited by claim 6 wherein said flexible container is sealed to an edge of said circuit board, and wherein said squib extends from said edge of said circuit board into said chemical mixture contained by said flexible container.

12. A security dye pack as recited by claim 1 wherein said substrate is a printed circuit board.

13. A security dye pack as recited by claim 12 wherein said squib has a pair of electrical leads, and wherein said electrical leads are connected to said printed circuit board.

14. A security dye pack as recited by claim 1 wherein the hollowed inner chamber of said housing has a predetermined length, and wherein said printed circuit board has a length shorter than said predetermined length.

15. A security dye pack as recited by claim 1 wherein said electronic circuit means includes battery means secured to said substrate for supplying electrical power to said electronic circuit means.

* * * * *